United States Patent [19]

Desclaux et al.

[11] Patent Number: 4,668,350

[45] Date of Patent: May 26, 1987

[54] CONTROLLING $ALF_3$ ADDITION TO AL REDUCTION CELL ELECTROLYTE

[75] Inventors: Paul Desclaux; Jean-Paul R. Huni, both of Jonquiere, Canada

[73] Assignee: Alcan International Limited, Montreal, Canada

[21] Appl. No.: 840,398

[22] Filed: Mar. 17, 1986

[30] Foreign Application Priority Data

Mar. 18, 1985 [EP] European Pat. Off. ..... 85301855.4

[51] Int. Cl.[4] ..... C25C 3/06; C25C 3/20

[52] U.S. Cl. ..... 204/67

[58] Field of Search ..... 204/67

[56] References Cited

U.S. PATENT DOCUMENTS 4,045,308 8/1977 White et al. ..... 204/67

4,377,452 3/1983 Casdas ..... 204/67

*Primary Examiner*—Howard S. Williams

*Attorney, Agent, or Firm*—Cooper, Dunham, Griffin & Moran

[57] ABSTRACT

A method for controlling the rate of aluminum fluoride addition to a cryolite-based electrolyte of an aluminum electrolytic reduction cell makes use of the known ratio between cell temperature and bath ($NaF:AlF_3$) ratio. A target temperature is established corresponding to a target bath ratio. The cell temperature is measured at intervals and the rate of $AlF_3$ addition altered depending on whether the measured temperature is above or below the target temperature. The method is faster than traditional methods involving analysis of electrolyte samples, and is amendable to computer control.

6 Claims, No Drawings

CONTROLLING $ALF_3$ ADDITION TO AL REDUCTION CELL ELECTROLYTE

The process of Hall and Heroult for the production of aluminium by the electrolytic reduction of alumina ($Al_2O_3$) involves the use of an electrolyte based on molten cryolite ($Na_3AlF_6$). The electrolyte contains an addition of 5 to 7% of aluminium fluoride ($AlF_3$), which lowers the melting point so as to permit operation in the range 950° to 1000° C., and lowers the content of reduced species in the electrolyte and thereby improves current efficiency. Losses of $AlF_3$ during operation of the cell are made good by addition of fresh $AlF_3$ to the electrolyte; for example, the $AlF_3$ requirement for a 275 KA cell may be around 60 Kg per day. Generally, a target ratio of NaF:$AlF_3$ is established for a cell, which may be for example around 1.10 by weight, and $AlF_3$ additions adjusted with reference to this ratio.

In conventional operation, samples of electrolyte are periodically withdrawn and analysed for bath ratio by determination of their chemical composition. The $AlF_3$ requirements of the electrolyte are deduced from the bias between the actual value of the bath ratio and the target value. This method has the disadvantage of requiring time for sampling and analysis (even though modern techniques such as X-ray diffraction may be used). Sample identities need to be carefully preserved to avoid mistakes. It is an object of the present invention to provide a method of controlling $AlF_3$ additions to the electrolyte, which is simpler and quicker and is amenable to computerized operation.

It is well known that, under steady state operation of a cell, there is a relationship between bath ratio and electrolyte temperature, which is substantially linear within the normal operating range specifically, as the bath ratio rises, (e.g. as a result of removal of $AlF_3$ from the system) the electrolyte temperature also rises. This relationship holds good over a range of about 10° C. greater or less than the target operating temperature of the cell, and it is with this fairly narrow range that the present invention is concerned. It may be noted that there are inevitably fluctuations of electrolyte temperature arising, for example, from changes in the anode-cathode distance or the $Al_2O_3$ concentration, but these are essentially short-term changes, continuing for minutes or at most a few hours. Since changes in bath ratio are measured over periods of at least several hours, these short-term changes can generally be ignored.

This invention makes use of the known dependence of electrolyte temperature on bath ratio to control the rate of addition of $AlF_3$ to the electrolyte. Thus in a broad sense, the invention provides a method of controlling the addition of $AlF_3$ to a cryolite-based electrolyte of an aluminium electrolytic reduction cell, which method comprises:

(a) establishing a target cell temperature ($T_t$),
(b) establishing a standard rate of addition of $AlF_3$,
(c) measuring the actual cell temperature (T),
(d) in response to the actual temperature measurement (c) altering the rate of addition of $AlF_3$, increasing the rate if T is greater than $T_t$, and decreasing the rate if T is less than $T_t$, and
(e) repeating steps (c) and (d) at intervals.

Establishing a target cell temperature is tantamount to establishing a target bath ratio, and can be done by conventional means. If desired, the method of this invention can be enlarged to alter the target cell temperature from time to time in the light of changing conditions. However, it is usually found that the target cell temperature remains constant during the life of the cell.

To establish a standard rate of addition of $AlF_3$, it is merely necessary to determine approximately the average $AlF_3$ requirements of the cell over a period of time. This standard rate may change with time.

Cell temperature may be measured in a variety of ways and at a variety of locations. It is possible to measure the electrolyte temperature directly; but, as noted above, this may not always be satisfactory due to short-term fluctuations in electrolyte temperature. Alternatively, cell temperature can be measured by means inserted in the side wall, or the floor, or in a cathode current collector in the cell floor. In cells with conventional carbon floors, horizontal steel bars are used to recover the current, and thermocouples can conveniently be positioned at intervals along a longitudinal hole in one of these. Temperature measurements effected within the wall or floor of the cell have the advantage that they should not be affected by short term fluctuations.

$AlF_3$ additions are generally made in batches at suitable intervals of time. Altering the rate of addition of $AlF_3$ may involve altering the size of the batches or the intervals between additions, or both. For example, the rate of $AlF_3$ addition may be doubled if the actual temperature is above the target temperature, or halved if the actual temperature is below the target temperature. This altered rate of addition may be continued for a specified time or until the next temperature measurement is effected. It should not be necessary to measure the actual cell temperature more than once every few hours, and indeed a measurement once every twenty-four hours generally provides a perfectly satisfactory level of control.

A preferred embodiment of the method of the invention comprises the following steps:

1. Establishing a target operating temperataure for the cell, which depends on the target bath ratio.
2. Establishing a standard $AlF_3$ addition rate which corresponds with the needs of a cell running in a stable condition at the target temperature.
3. Measuring the actual cell temperature on a regular basis, e.g. every twenty-four hours.
4. Determining a first correction based on the difference between the actual measured temperature and the target temperature.
5. Determining a second correction based on the difference between the actual measured temperature and the preceding measured temperature.
6. Applying the first and second corrections to the standard $AlF_3$ addition rate to define a corrected $AlF_3$ addition rate.
7. Making $AlF_3$ additions to the electrolyte at that corrected rate within a given period of time after making the temperature measurement.

The method of the invention can easily be applied to computer control of cell operation by applying the following formula:

$$A_{n+1} \times K_1(T_t - T_n) + K_2(T_n - T_{n-1}) + A_s$$

Where $A_{n+1}$ is the corrected $AlF_3$ addition to be made during period n+1.

$A_s$ is the standard $AlF_3$ addition corresponding to the needs of the cell when stable at the target temperature.

$T_t$ is target electrolyte temperature of the operating cell.

$T_n$ is actual measured electrolyte temperature at the point of time n.

$T_{n-1}$ is the actual temperature obtained by the preceding measurement at commencement of period n−1.

$K_1$ is a constant which is applied to the difference between $T_t$ and $T_n$ to obtain a first required correction.

$K_2$ is a constant which is applied to the difference between $T_n$ and $T_{n-1}$ to obtain a second required correction.

$K_1$ and $K_2$ are functions of cell size and amperage and desired speed of response. They may be a established by a statistical analysis of the relationship between change in electrolyte temperature and $AlF_3$ requirements. However, if $K_1$ and $K_2$ are chosen such that the speed of response is too rapid, then there is a danger of overcontrol. K, should generally be larger than, and opposite in sign to, $K_2$. In practice, the value of K, is found to vary in approximate linear relationship with the volume of molten cell electrolyte.

EXAMPLE

In a 275 KA cell, the following values were determined by experiment.

$T_t$=955° C., this corresponding to a desired bath ratio of 1.10.

$A_s$=60 Kg/24h.

$K_1$=−5 Kg/°C. day.

$K_2$=2 Kg/°C. day.

During an eleven day period the cell electrolyte was sampled for bath ratio determination once every 24h., electrolyte temperature being measured at the time of sampling. The following table shows the $AlF_3$ additions required according to the above mentioned formula.

| Electrolyte Temperature °C. | Bath Ratio | $AlF_3$ Addition Kg/24 h. |
|---|---|---|
| 947 | 1.09 | 28 |
| 949 | 1.04 | 34 |
| 949 | 1.10 | 30 |
| 948 | 1.07 | 23 |
| 952 | 1.10 | 53 |
| 951 | 1.05 | 38 |
| 952 | 1.11 | 47 |
| 960 | 1.06 | 101 |
| 947 | 1.07 | nil* |
| 948 | 1.09 | 27 |
| 947 | 1.05 | 18 |

*Formula gave negative value

At no time during this period did the bath ratio deviate from the target by more than 0.05.

We claim:

1. A method of controlling the addition of $AlF_3$ to a cryolite-based electrolyte of an aluminium electrolytic reduction cell, which method comprises:

(a) establishing a target cell temperature ($T_t$), (b) establishing a standard rate of addition of $AlF_3$, (c) measuring the actual cell temperature (T), (d) in response to the actual temperature measurement (c) altering the rate of addition of $AlF_3$, increasing the rate if T is greater than $T_t$, and decreasing the rate if T is less than $T_t$, and (e) repeating steps (c) and (d) at intervals.

2. A method of controlling the addition of $AlF_3$ to a cryolite-based electrolyte of an aluminium electrolytic reduction cell, which method comprises the following steps:

(a) Establishing a target operating temperature for the cell, which depends on the target bath ratio, (b) Establishing a standard $AlF_3$ addition rate which corresponds with the needs of a cell running in a stable condition at the target temperature, (c) Measuring the actual cell temperature on a regular basis, (d) Determining a first correction based on the difference between the actual measured temperature and the target temperature, (e) Determining a second correction based on the difference between the actual measured temperature and the preceding measured temperature, (f) Applying the first and second corrections to the standard $AlF_3$ addition rate to define a corrected $AlF_3$ addition rate, (g) Making $AlF_3$ additions to the electrolyte at that corrected rate within a given period of time after making the temperature measurement.

3. A method as claimed in claim 2, wherein step f is performed by means of the following formula:

$$A_{n+1}=K_1(T_t-T_n)+K_28T_n-T_{n-1})+A_s$$

where $A_{n+1}$ is the corrected $AlF_3$ addition to be made during period n+1, $A_s$ is the standard $AlF_3$ addition corresponding to the needs of the cell when stable at the target temperature, $T_t$ is target electrolyte temperature of the operating cell, $T_n$ is actual measured electrolyte temperature at the point of time n, $T_{n-1}$ is the actual temperature obtained by the preceding measurement at commencement of period n−1, $K_1$ is a constant which is applied to the difference between $T_t$ and $T_n$ to obtain a first required correction, $K_2$ is a constant which is applied to the difference between $T_n$ and $T_{n-1}$ to obtain a second required correction.

4. A method as claimed in claim 3, wherein $K_1$ and $K_2$ are established by statistical analysis of the relationship between change in electrolyte temperature and $AlF_3$ requirements.

5. A method as claimed in claim 2, wherein control of the cell is performed by a computer.

6. A method as claimed in claim 1, wherein control of the cell is performed by a computer.

* * * * *